US006711100B2

(12) United States Patent
Rochat et al.

(10) Patent No.: US 6,711,100 B2
(45) Date of Patent: Mar. 23, 2004

(54) TIMEPIECE PROVIDED WITH A DATE HAVING A LARGE APERTURE

(75) Inventors: Jean-Philippe Rochat, Bienne (CH); Lucienne Serex, Prêles (CH)

(73) Assignee: Eta SA Fabriques d'Ebauches (CH)

( * ) Notice: Subject to any disclaimer, the term of this patent is extended or adjusted under 35 U.S.C. 154(b) by 280 days.

(21) Appl. No.: 10/026,304

(22) Filed: Dec. 18, 2001

(65) Prior Publication Data

US 2002/0080687 A1 Jun. 27, 2002

(30) Foreign Application Priority Data

Dec. 22, 2000 (CH) ..... 2522/00

(51) Int. Cl.[7] ..... G04B 19/20; G04B 19/24; G04B 37/00

(52) U.S. Cl. ..... 368/35; 368/37

(58) Field of Search ..... 368/28, 31–38

(56) References Cited

U.S. PATENT DOCUMENTS 4,188,774 A * 2/1980 Besson
4,257,113 A 3/1981 Meister et al.
5,282,179 A * 1/1994 Vuilleumier ..... 368/28

* cited by examiner

*Primary Examiner*—Vit Miska
(74) *Attorney, Agent, or Firm*—Richard K Robinson

(57) ABSTRACT

The timepiece carries a date with a large aperture including a units indicator (9) and a tens indicator (10). Between these indicators and a date control crown-wheel (14) are located mechanisms (17, 18) for driving said indicators, these mechanisms each being provided with a locking system (30, 52) preventing any inadvertent movement of these indicators when shocks are applied to the timepiece.

11 Claims, 7 Drawing Sheets

TIMEPIECE PROVIDED WITH A DATE HAVING A LARGE APERTURE

Figure 1:
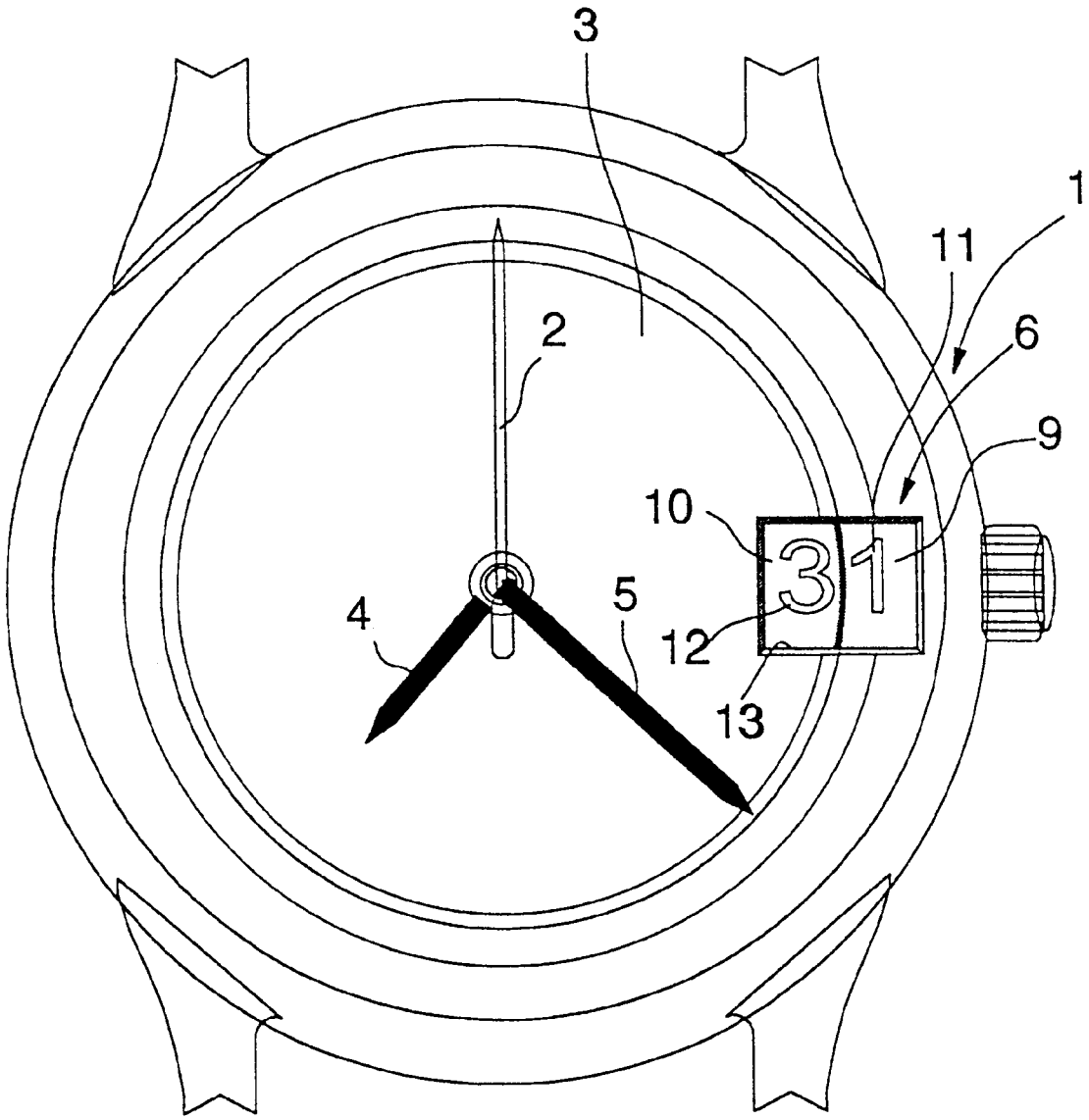

The present invention relates to a timepiece including hands moving above a dial and a date formed of first and second indicators on which figures are affixed indicating respectively the units and tens of said date, this date appearing through a large aperture made in the dial, said date being driven by a date crown-wheel making one revolution in thirty one days at a rate of one step per day, this crown-wheel being arranged to drive the first indicator by one step at the end of every day except at the end of the thirty-first day when it is not driven, and the second indicator at the end of the ninth, nineteenth, twenty ninth and thirty-first day of the month, said first and second indicators each being fitted with a device enabling them to keep a defined angular position when they are not being driven.

A timepiece with a large aperture corresponding to the generic description hereinbefore has already been proposed. This timepiece includes a date crown-wheel arranged to make one revolution in thirty-one days at the rate of one step at the end of each day. This crown-wheel includes two distinct toothings.

A first toothing includes thirty active teeth evenly distributed over a sector occupying the thirty thirty-first parts of the periphery of the crown-wheel so that one thirty-first part of this periphery has no teeth. This first toothing is meshed with a first star wheel carrying a disc on which the date units are affixed. It will be understood that this disc is not driven when the toothless sector of the crown-wheel is in front of the star wheel. This absence of driving is thus arranged to occur between the thirty-first of the month and the first day of the next month. Consequently, the units disc displays the FIG. 1 on two consecutive days, namely the 31 of the month which is ending and the 1 of the month which is beginning.

A second toothing carries four active teeth. This second toothing is meshed with a second star wheel carrying a disc on which the tens of the date are affixed. These four active teeth are arranged on the periphery of the crown-wheel so as to drive this tens disc by one step at the end of the ninth, nineteenth, twenty-ninth and thirty-first days of the month, the tens disc thus displaying respectively 1, 2, 3 and 0.

The units and tens discs are arranged side by side and the figures which they bear appear in a large aperture made in the dial and located on a six-o'clock—midday line of the timepiece. In order to index the figures of each of the discs correctly when they are in their last position, a jumper spring is provided, acting on each of the teeth of the corresponding star wheel, these jumper springs allowing a defined angular position of the discs in question when the system is in its rest position.

Since the diameter of the discs is small, the pressure which the jumper springs exert on the respective star wheels must not be high to keep the discs in place, even in the event of shocks applied to the timepiece.

If, however, one wishes to place the date at three o'clock on the timepiece or around this point (for example between one o'clock and seven o'clock), the construction proposed hereinbefore is not suitable and one has to use at least one indicator of large diameter having the shape of a ring covering a zone located at the periphery of the timepiece, a preferred construction lying in the use of two moving parts of large diameter located concentrically with respect to each other.

In this case, the simple jumper springs proposed hereinbefore, if they properly fulfil the functions expected of them in normal use, are totally insufficient if shocks are applied to the timepiece, since, in such circumstances, the indicators, because of their large size, can move forward or backwards inadvertently and even randomly so that the synchronisation which should exist between these indicators may be broken and no conventional date correction by the stem can correct it. The timepiece then has to be opened to re-establish the lost synchronisation.

In order to overcome this drawback, one could of course increase the pressure exerted by jumper springs on the indicators. However, such measures would have the effect of considerably increasing the torque to be provided by the motor member of the timepiece so that the working autonomy is greatly reduced.

The present invention has found a remedy for this drawback by proposing a system of locks acting on the mechanisms present, these locks consuming no or very little energy while locking the date indicators when they are not being driven normally by the timepiece movement.

To this end, the timepiece of the invention, in addition to answering the definition given hereinbefore in the first paragraph of this description, is characterised in that a first mechanism is inserted between the crown-wheel and the first indicator and that a second mechanism is inserted between the crown-wheel and the second indicator, these first and second mechanisms each being provided with means both rotating the corresponding indicator from the crown-wheel and locking said first and second indicators when they are not being driven by said crown-wheel.

Figure 2:
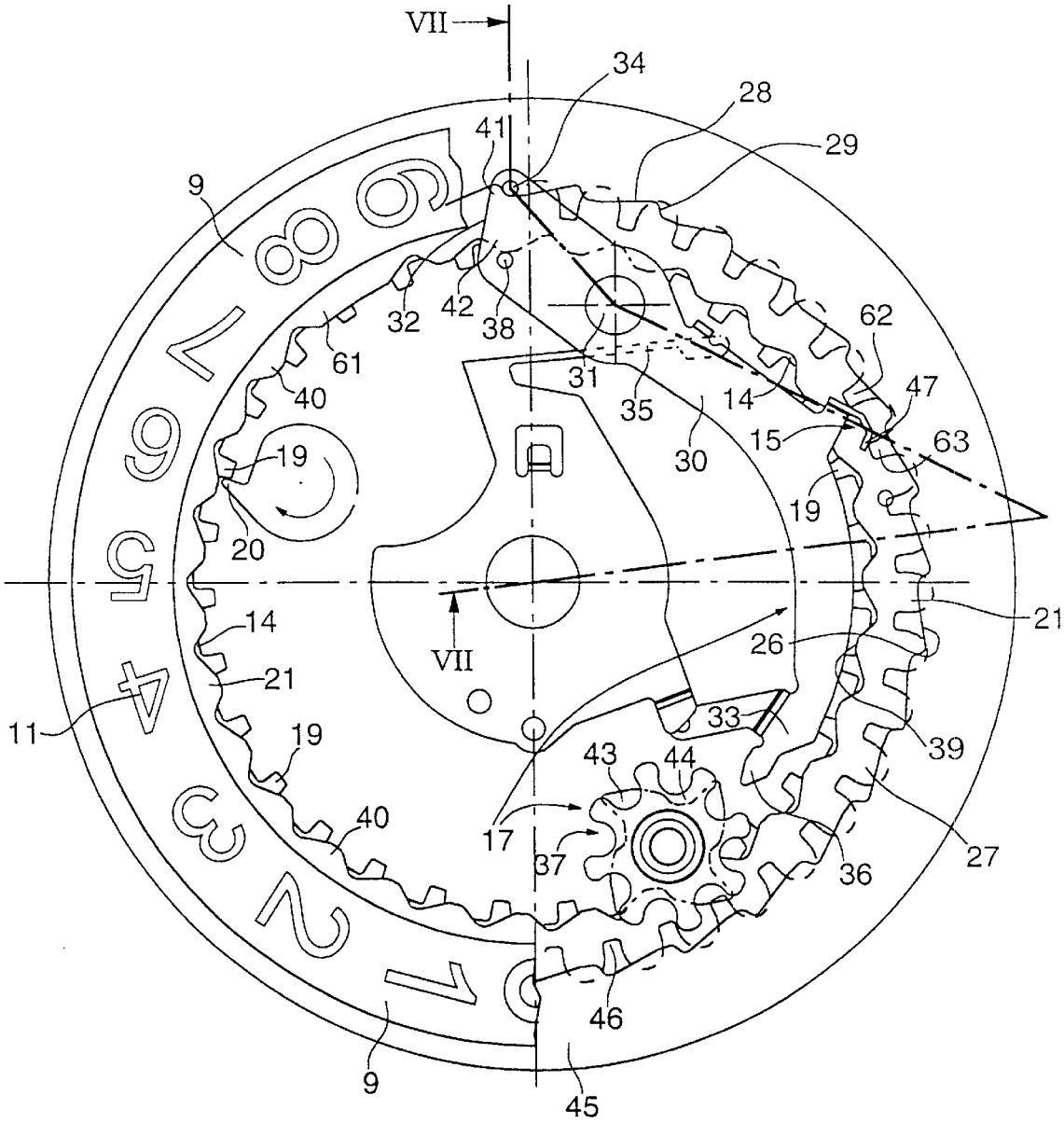
Figure 3:
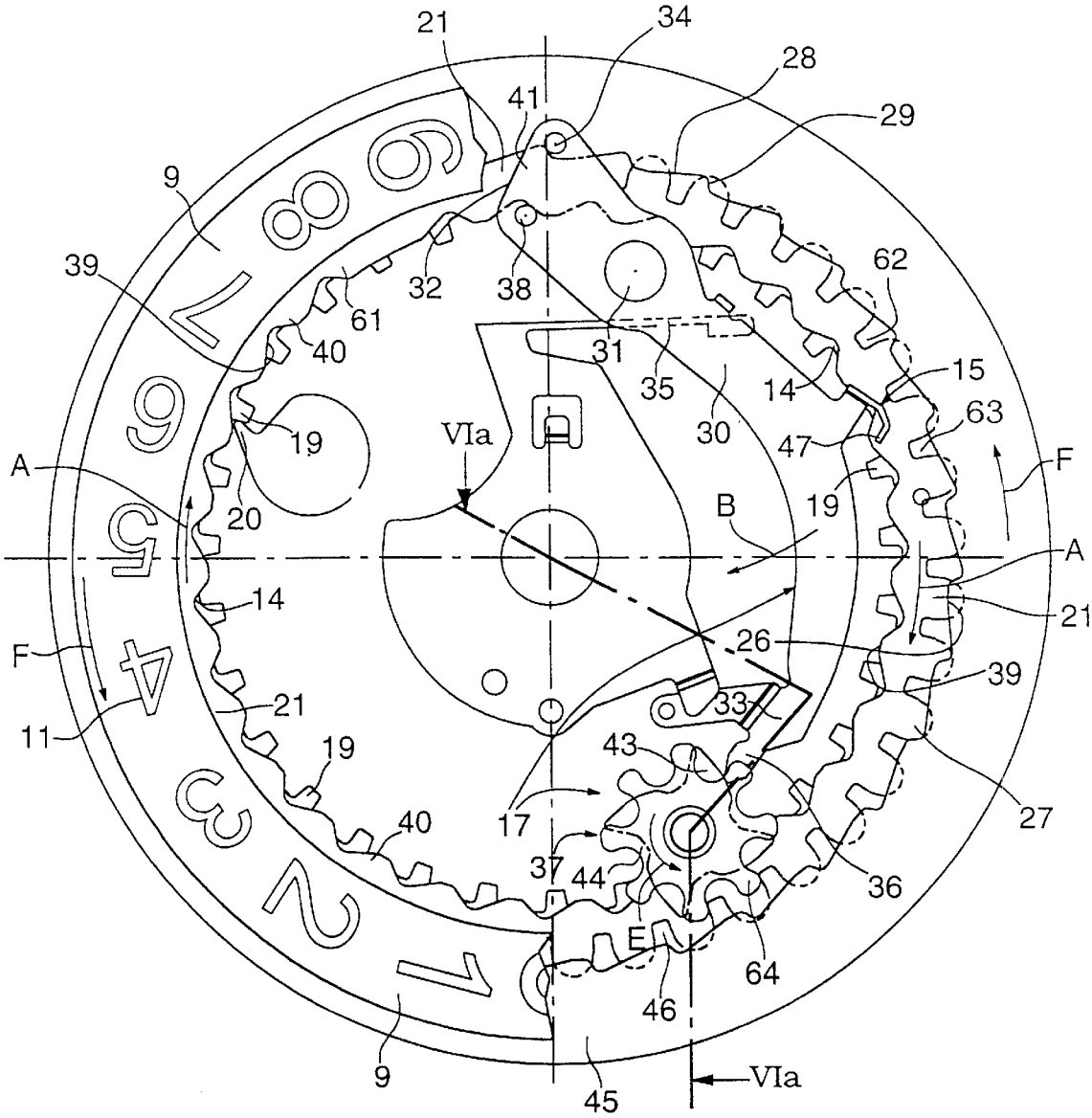
Figure 4:
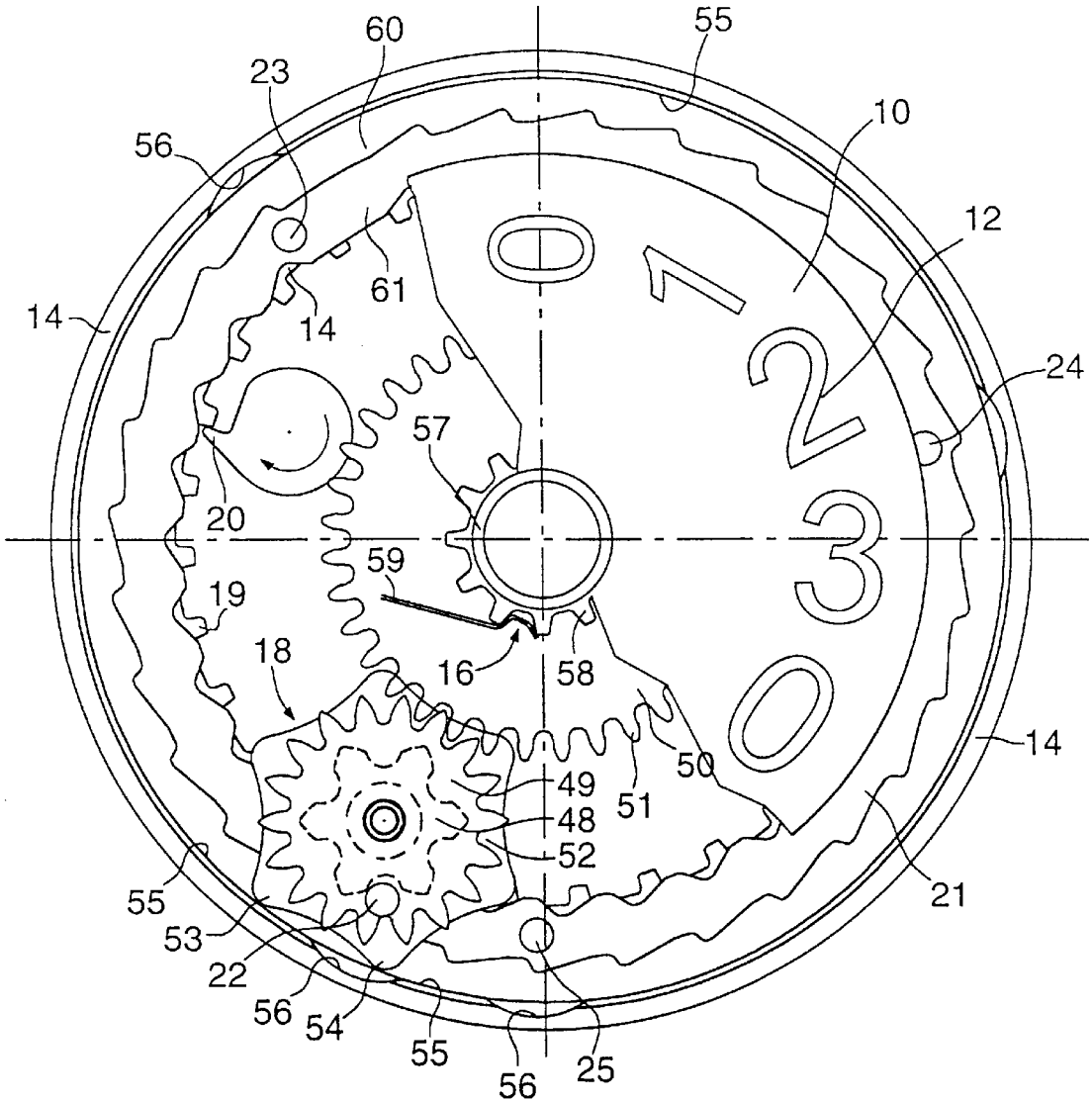
Figure 5:
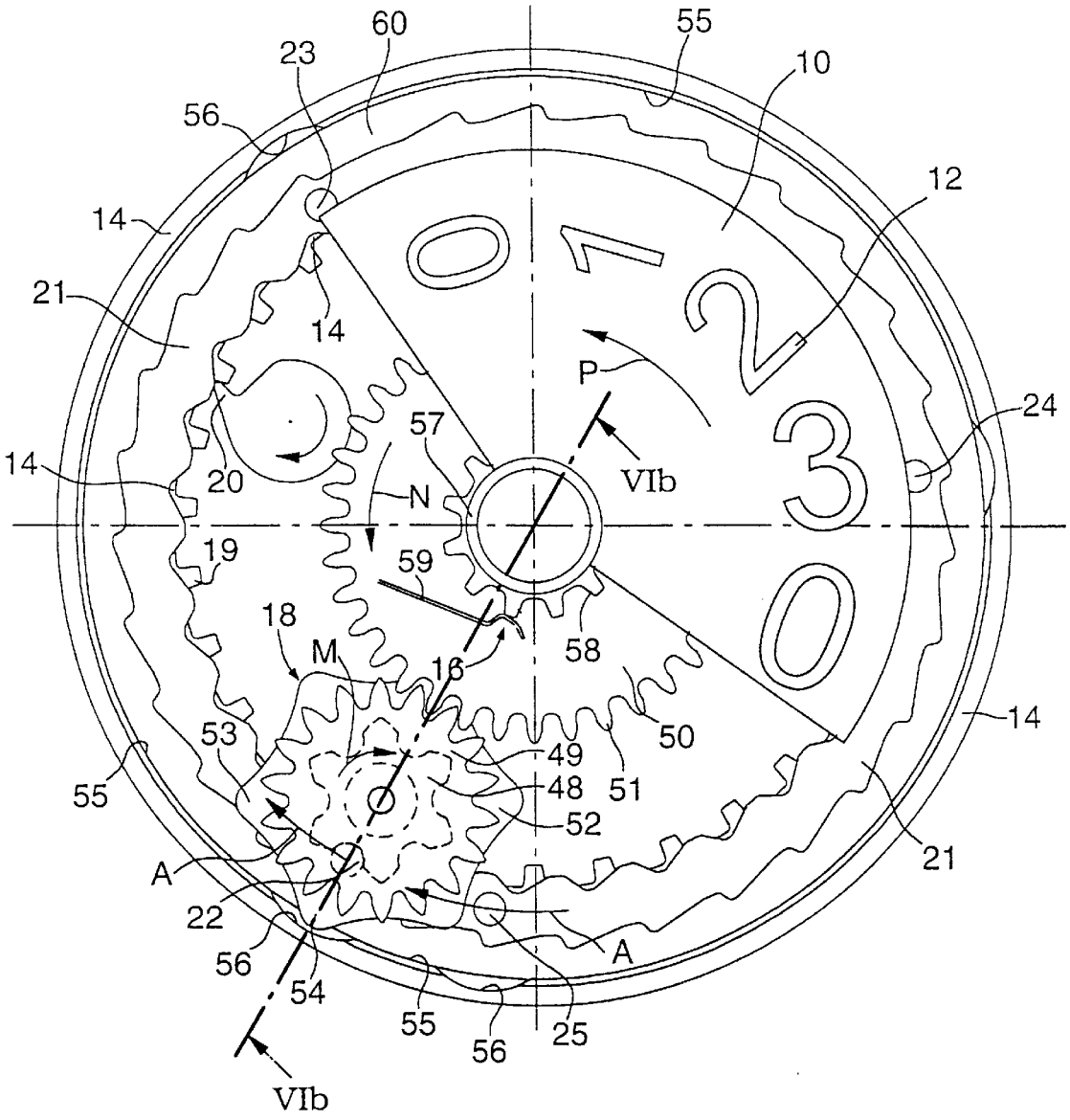
Figure 6:
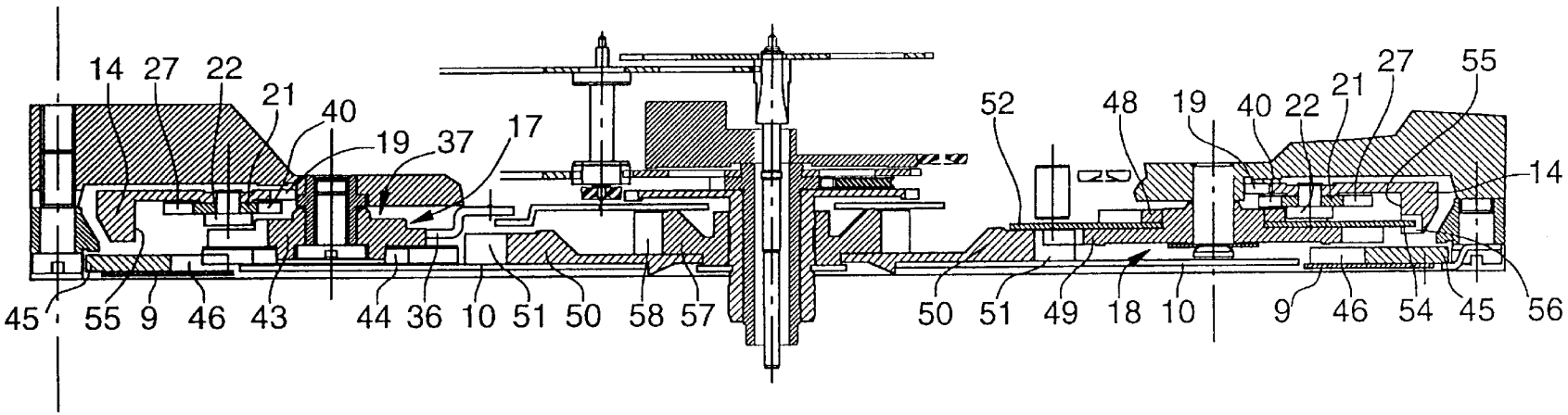
Figure 7:
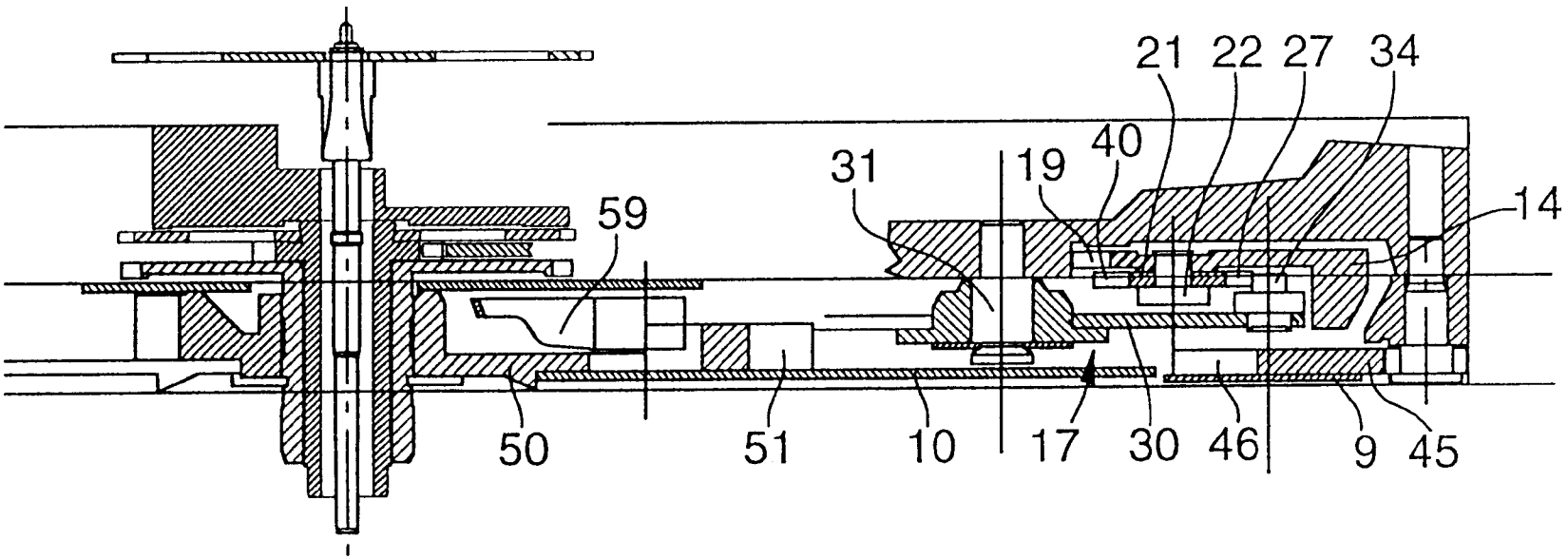

The invention will be described in more detail now relying on the following description, which is illustrated by the annexed drawings given by way of an example of an embodiment, and in which:

FIG. 1 is a view showing the general appearance, according to the invention, of the calendar watch including a large aperture in which appear an indicator of the units and indicator of the tens of the date, FIG. 2 shows the drive mechanism for the units indicator in a phase in which it is locked, FIG. 3 shows the drive mechanism of the units indicator in a phase in which it is being driven, FIG. 4 shows the drive mechanism of the tens indicator at the end of locking phase, FIG. 5 shows the drive mechanism of the tens indicator in the drive phase, FIG. 6 shows on the left a cross-section along the line VIa—VIa of FIG. 3, and on the right, a cross-section along the line VIb—VIb of FIG. 5, and FIG. 7 shows a cross-section along the line VII—VII of FIG. 2.

FIG. 1 shows a plan view of a timepiece 1 according to the invention. This timepiece includes time indicating hands 2, 4 and 5 which move on a dial 3 and a date 6 displaying the date of the month. The date is formed of first 9 and second 10 indicators onto which figures are affixed indicating respectively the units 11 and the tens 12 of the date, the latter appearing through a large aperture 13 made in dial 3.

As is apparent in the following Figures, the date, i.e. indicators 9 and 10 which form it, is driven by a date crown-wheel 14 which completes a revolution in thirty one days at a rate of one step per day via a finger 20 activated by a movement of the timepiece, this finger being meshed on an inner toothing of the crown-wheel, this toothing being formed of thirty one teeth 19.

Crown-wheel 14 is arranged to drive first indicator 9 one step per day at the end of every day except at the end of the thirtieth day when it is not driven. This same crown 14 is arranged to drive second indicator 10 at the end of the ninth, nineteenth, twenty-ninth and thirty first days of the month. The way in which the indicators are driven will be described in more detail hereinafter. As is usually the case and as FIGS. 2, 3, 4 and 5 show, first and second indicators 9 and 10 are each provided with a device, referenced respectively 15 and 16, allowing them to maintain a defined angular position when they are not being driven.

As is usually the case and as FIGS. 2, 3, 4 and 5 show, first and second indicators 9 and 10 are each provided with a device, referenced respectively 15 and 16, allowing them to maintain a defined angular position when they are not being driven.

This being so and as is clear in FIGS. 2 and 3, the invention is characterised in that a first mechanism 17 is inserted between crown-wheel 14 and first indicator 9, this first mechanism being provided with means for both rotating first indicator 9 from crown-wheel 14 and for locking said indicator when it is not being driven.

In the same way, as is clearly shown in FIGS. 4 and 5, the invention is characterised in that a second mechanism 18 is inserted between crown-wheel 14 and second indicator 10, this second mechanism being provided with means for both rotating second indicator 10 from crown-wheel 14 and for locking said indicator when it is not being driven.

A preferred embodiment example of the first and second mechanisms inserted between date crown-wheel 14 and the respective first and second indicators will now be described more precisely. It will be noted first of all (see more particularly the cross-section of FIG. 7) that a ring 21 for driving first mechanism 17 is secured to crown-wheel 14. It can also be seen (right part of FIG. 6) that a plurality of studs 22 to 25 are secured to crown-wheel 14, only one stud 22 being shown in FIG. 7, the other studs being visible in FIGS. 4 and 5, these studs being arranged to activate second mechanism 18. The way in which the units and tens indicators are driven and locked will now be described in succession.

Driving and Locking the Units Indicator

Reference will be made here to FIGS. 2, 3, 6 and 7. The outer edge 26 of ring 21 carried by crown-wheel 14 includes thirty particular teeth 27 which are evenly distributed over a sector occupying the thirtieth thirty-first parts of the periphery of the ring. Each tooth is preceded by a flank having a steep ramp 29 then followed by a flank having a gentle ramp 28 to form an outer cam wherein one tooth is missing (see reference 60 in FIGS. 4 and 5).

First mechanism 17 is formed of a lever 30 pivoting on a shaft 31 secured to the plate of the movement. The first end 32 of this lever is fitted with a first pin 34 which is applied, via the effect of a return spring 35 acting on the lever, against outer edge 26 of ring 21. When ring 21 is driven in rotation, pin 34 follows the outer edge 26 of the ring like a finger sliding against a cam. Lever 30 is then animated by a back and forth movement, this movement being generated, at the end of all the days of the month, except at the end of the thirty-first day when said movement does not occur, the pin then following a tooth-free path (reference 60 referred to hereinbefore). The back and forth movement is passed on to the second end 33 of lever 30 which, via a first beak 36 with which it is provided, in turn drives a wheel 37 in rotation, this wheel being arranged to drive first indicator 9.

FIGS. 2 and 3 also show that first end 32 of lever 30 is provided with a second pin 38 arranged to follow the inner edge 39 of ring 21, this inner edge 39 also carrying thirty particular teeth 40 which are evenly distributed over a sector occupying the thirtieth and thirty-first parts of the periphery of the ring to form an inner cam which lacks a tooth cavity (see reference 61 in FIGS. 2, 3 and 4). The orientation of the inner cam is arranged so that its sector 61 which has no tooth cavity is located facing sector 60 which has a tooth missing on the outer cam. Moreover, first and second pins 34 and 38 and teeth 27 to 40 disposed on outer and inner edges 26 and 39 of ring 21 are arranged so that when the ring is not being driven, first pin 34 is located at the bottom of steep ramp 29 of one of teeth 41 of the outer edge of the ring, whereas second pin 38 is positioned substantially at the top of one of teeth 42 of the inner edge of the ring. This situation is shown in FIG. 2. In these conditions, lever 30 is locked and it is impossible for it to activate wheel 37 inadvertently and, thereby, first indicator 9, if a shock is applied to the timepiece.

Wheel 37 arranged between first beak 36 of lever 30 and first indicator 9 includes a star-wheel 43 profiled so as to be driven in rotation by first beak 36. Wheel 37 also includes a pinion 44 mounted coaxial to and secured to star-wheel 43. Pinion 44 is meshed with a crown-wheel 45 provided with an inner toothing 46. This crown-wheel 45 carries first indicator 9 to which the FIG. 11 indicating the units of the date are affixed.

FIGS. 2 and 3 show finally that lever 30 is provided with a device 15 including a second beak 47 arranged to co-operate with toothing 46 of crown-wheel 45. When first indicator 9 is not being driven, device 15 assures first a defined angular position of first indicator 9 and secondly the locking thereof. This situation is explained in FIG. 2 which shows second beak 47 inserted between two teeth 62 and 63 and toothing 46 of crown-wheel 45. It will be understood here that device 15 has two purposes: that of indexing units indicator 9 first of all, and then that of positively locking it to prevent it from rotating inadvertently if the timepiece undergoes a shock.

FIG. 3 shows units indicator 9 at the start of driving. Finger 20 driven by the timepiece movement starts to drive a tooth 19 of date crown-wheel 14 which rotates with ring 21 which is associated therewith in the clockwise direction referenced by arrow A. Pin 34 of lever 30 climbs onto the steep flank of tooth 41 of ring 21 activating the lever in the direction of arrow B. First beak 36 of lever 30 has come into contact with star-wheel 43 and slides along one of its flanks to make it rotate in the anti-clockwise direction referenced by arrow E. A wing 64 of pinion 44 associated with star-wheel 43 has come into contact with a tooth 46 of crown-wheel 45 which begins to rotate in the anti-clockwise direction referenced by arrow F which drives indicator 9, which is associated to crown-wheel 45, in the same direction. In the meantime, second beak 47 of lever 30 has been released from teeth 62 and 63 of crown-wheel 45 allowing the units indicator to progress by one step with complete freedom.

It will be observed here that the gear ratio between star-wheel 43, pinion 44 and toothing 46 of crown-wheel 45 is selected so that FIG. 11 affixed to units indicator 9 are twenty in number, namely two series of ten figures from zero to nine.

Driving and Locking the Tens Indicator

Reference will be made for this description to FIGS. 4, 5 and 6. Date crown-wheel 14 carries four studs 22, 23, 24 and 25, these studs also being used as means for securing ring 21 onto crown-wheel 14. These studs are arranged and disposed angularly on crown-wheel 14 so as to drive second mechanism 18 in rotation at the end of the ninth, nineteenth, twenty-ninth and thirty-first days of the month. The second mechanism takes the form of an intermediate wheel and pinion 18 on the one hand driven by one of the four studs 22 to 25 and on the other hand arranged to mesh with second tens indicator 10.

Intermediate wheel and pinion 18 includes a first wheel 48 arranged to be moved forward in rotation by studs 22 to 25 of date crown-wheel 14 and a second wheel 49 mounted coaxial to and secured to first wheel 48. Second wheel 49 meshes with a plate 50 provided with teeth 51. Plate 50 carries second indicator 10 to which FIG. 12 indicating the tens of the date are affixed. FIGS. 4 to 6 also show that intermediate wheel and pinion 18 includes a bolt 52 which prevents said wheel and pinion from rotating, and consequently also plate 50 which is connected thereto, when the wheel and pinion is not being driven by one of studs 22 to 25 of date crown-wheel 14. The main object of this bolt is to block tens indicator 10 and thus to prevent if from moving inadvertently if the timepiece undergoes a shock.

Several bolt shapes may be envisaged for blocking the mechanism. A plate 52 with a hexagonal cut out portion has been used here, fixedly secured to the intermediate wheel and pinion and coaxial thereto. When wheel and pinion 18 is not being driven by pin 22, FIG. 4 shows that two neighbouring tips 53 and 54 of plate 52 abut against an edge 55 of crown-wheel 14. Conversely, when wheel and pinion 18 is being driven by pin 22, tip 54 of plate 52 can pass into a recess 56 made in edge 55 of the crown-wheel as is illustrated in FIG. 5. The situation illustrated by FIG. 5 shows the passage from the twenty-ninth to the thirtieth day of the month. It will be understood that there are as many recesses 56 as studs on crown-wheel 14. The next recess 56 located facing stud 25 will allow wheel and pinion 18 to be unlocked during the passage from the thirty-first day to the first day of the next month.

As already mentioned in the above paragraph and as is seen in FIG. 5, finger 20 driven by the timepiece movement begins to drive a tooth 19 of date crown-wheel 14 which rotates with studs 22 to 25 which are associated therewith in the clockwise direction referenced by arrow A. Stud 22 drives first wheel 48 then second wheel 49 which is connected thereto in the direction of arrow M, this second wheel in turn driving plate 50 and indicator 10 which is associated therewith in an anti-clockwise direction referenced respectively by arrows N and P. The tens figure appear in the aperture before the change was the three (FIG. 4). During the change (FIG. 5), the tens figure appearing in the aperture is the end of the figure three and the beginning of the figure zero, if the aperture is located at three o'clock.

It will be observed here that the gear ratio between wheel 48, wheel 49 and plate 50 is selected so that FIG. 12 affixed to tens indicator 10 are twelve in number, namely three series of four figures from zero to three. Indicator 10 thus makes a revolution in three months.

It was mentioned hereinbefore that second indicator 10 is provided with a device 16 allowing it to maintain a defined angular position when it is not being driven. As FIGS. 4 and 5 show, this device is formed of a wheel 57 fixed under plate 50, this wheel having teeth 58 on which a jumper spring 59 acts, the illustrated shape of such spring being merely an example embodiment.

Final Remarks

In addition to including an original mechanism referenced 17, 18 respectively, between date crown-wheel 14 and each of units and tens indicators 9 and 10, the large date aperture which has just been described is characterised by the safety which it provides as regards its sensitivity to the various shocks that a timepiece may undergo. This lack of sensitivity is assured as a result of bolts which lock the mechanisms when they are not being driven. These bolts advantageously replace jumper springs which, as has been shown, consume a great deal of energy. The bolts described are positive means for blocking a mechanism and not resilient means, like jumper springs, which are certainly efficient at indexing an indicator with accuracy (see jumper spring 59 which indexes tens indicator 10) but are powerless to prevent inadvertent movements due to shocks exerted on the timepiece.

What is claimed is:

1. A timepiece including time indicator hands moving above a dial and a date formed of first and second indicators on which figures are affixed indicating respectively the units and tens of said date, this date appearing through a large aperture made in the dial, said date being driven by a date crown-wheel making one revolution in thirty-one days at a rate of one step per day, this crown-wheel being arranged to drive the first indicator by one step at the end of every day except at the end of the thirty-first day when it is not driven, and the second indicator at the end of the ninth, nineteenth, twenty-ninth and thirty-first day of the month, said first and second indicators each being fitted with a device enabling them to maintain a defined angular position when they are not being driven, characterised in that a first mechanism is inserted between the crown-wheel and the first indicator and wherein a second mechanism is inserted between the crown-wheel and the second indicator, these first and second mechanisms each being provided with means for both rotating the corresponding indicator from the crown-wheel and for locking said first and second indicators when they are not being driven by said crown-wheel.

2. A timepiece according to claim 1, wherein the crown-wheel carries a toothing having thirty-one teeth, said crown-wheel being driven by said toothing by one step per day via a finger activated by a movement included in the timepiece and in that on the crown-wheel are fixed a ring to move the first mechanism and a plurality of studs arranged to activate the second mechanism.

3. A timepiece according to claim 2, wherein the outer edge of the ring carries thirty particular teeth evenly distributed over a sector occupying the thirty thirty-first parts of the periphery of the ring, the flanks of each tooth respectively having a steep ramp and a gentle ramp, and in that the first mechanism is formed of a lever pivoting on a shaft secured to the movement, the first end of the lever being fitted with a first pin applied, via the effect of a spring acting on the lever, against the outer edge of the ring, the lever then being animated by a back-and-forth movement when the ring is being driven in rotation, this movement being generated at the end of every day of the month, except at the end of the thirty-first day, said back-and-forth movement being passed on to the second end of the lever which, via a first beak with which it is provided, in turn drives in rotation a wheel and pinion, this wheel and pinion being arranged to drive the first indicator.

4. A timepiece according to claim 3, wherein the first end of the lever is fitted with a second pin arranged to follow the inner edge of the ring, this inner edge also carrying thirty particular teeth evenly distributed over a sector occupying the thirty and thirty-first parts of the periphery of the ring, the first and second pins and the teeth disposed on the outer and inner edges of the ring being arranged such that when the ring is not being driven, the first pin is located at the bottom of the steep ramp of one of the teeth of the outer edge of the ring, whereas the second pin is positioned substantially at the top of one of the teeth of the inner edge of the ring, which as the effect of locking the lever and preventing any inadvertent movement of the wheel and pinion driving the first indicator.

5. A timepiece according to claim 3, wherein the wheel and pinion arranged between the first beak of the lever and the first indicator includes a star-wheel profiled to be driven in rotation by said first beak, and a pinion mounted coaxial to and secured to the star-wheel, this pinion being meshed with a crown-wheel provided with an inner toothing, this crown-wheel carrying the first indicator to which the figures indicating the units of the date are affixed.

6. A timepiece according to claim 5, wherein the lever is provided with a second beak arranged to co-operate with the inner toothing of the crown-wheel to assure a defined angular position of the first indicator and to lock it when it is not being driven.

7. A timepiece according to claim 2, wherein the date crown-wheel carries four studs arranged to drive in rotation the second mechanism at the end of the ninth, nineteenth, twenty-ninth and thirty-first days of the month, this second mechanism taking the form of an intermediate wheel and pinion meshed with the second indicator.

8. A timepiece according to claim 7, wherein the intermediate wheel and pinion includes a first wheel arranged to be moved forward by the studs of the crown-wheel and a second wheel mounted coaxial to and secured to the first wheel, this second wheel being meshed with a plate provided with teeth, this plate carrying the second indicator to which the figures indicating the tens of the date are affixed.

9. A timepiece according to claim 7, wherein the intermediate wheel and pinion further includes a bolt preventing said wheel and pinion from rotating when it is not being driven by one of the studs of the crown-wheel.

10. A timepiece according to claim 9, wherein the bolt is a plate with a hexagonal cut out portion secured to the intermediate wheel and pinion and mounted coaxial thereto, two neighbouring tops of the plate abutting against an edge of the crown-wheel when the wheel and pinion is not being driven, this edge having recesses into which said tops can pass when the wheel and pinion is being driven.

11. A timepiece according to claim 8, wherein under the plate provided with teeth is fixed a wheel on the teeth of which a jumper spring acts to assure a defined angular position of said plate when the latter is not being driven.

* * * * *